US009197968B2

(12) United States Patent
Klinghult

(10) Patent No.: US 9,197,968 B2
(45) Date of Patent: Nov. 24, 2015

(54) LOUDSPEAKER ACTUATOR

(75) Inventor: Gunnar Klinghult, Lund (SE)

(73) Assignees: Sony Corporation, Tokyo (JP); Sony Mobile Communications AB, Lund (SE)

( * ) Notice: Subject to any disclaimer, the term of this patent is extended or adjusted under 35 U.S.C. 154(b) by 2742 days.

(21) Appl. No.: 11/625,404

(22) Filed: Jan. 22, 2007

(65) Prior Publication Data

US 2008/0175428 A1 Jul. 24, 2008

(51) Int. Cl.

| | |
|---|---|
| ***H04R 1/00*** | (2006.01) |
| ***H04R 23/00*** | (2006.01) |
| ***H04R 7/16*** | (2006.01) |
| ***H04R 7/24*** | (2006.01) |

(52) U.S. Cl.

CPC ..... *H04R 23/00* (2013.01); *H04R 7/16* (2013.01); *H04R 7/24* (2013.01); *H04R 2499/11* (2013.01)

(58) Field of Classification Search

CPC ..... H04R 7/04; H04R 7/16; H04R 7/18; H04R 7/20; H04R 7/24; H04R 7/26; H04R 23/00; H04R 2231/003; H04R 2307/027; H04R 2440/07; H04R 2499/11

USPC ..... 381/152, 162, 402, 408, 423, 424, 426, 381/427, 431, 398; 181/167, 168

See application file for complete search history.

(56) References Cited

U.S. PATENT DOCUMENTS 5,005,678 A * 4/1991 Julien et al. ..... 188/378
6,563,934 B1 5/2003 Swope et al.

FOREIGN PATENT DOCUMENTS

| | | |
|---|---|---|
| GB | 2 362 719 | 11/2001 |
| JP | 60-153099 | 10/1985 |
| JP | 3-32156 Y | 7/1991 |
| JP | 2000-152392 | 5/2000 |
| WO | 2005-075823 | 8/2005 |

OTHER PUBLICATIONS

International Search Report and Written Opinion for corresponding Application No. PCT/EP2007/057178 dated Oct. 5, 2007.

Y.H. The & R. Featherstone; "Experiments on the Audio Frequency Response of Shape Memory Alloy Actuators" Australasian Conf. Robotics and Automation (ACRA 2005); 2005; pp. 1-6; Sydney, Australia; XP002451540.

European Patent Office Communication for corresponding European Application No. 07 787 449.3 dated Aug. 24, 2010.

South Korean Office Action for corresponding South Korean Application No. 2009-7009402 dated Jul. 9, 2013.

* cited by examiner

*Primary Examiner* — Huyen D Le

(74) *Attorney, Agent, or Firm* — Renner, Otto, Boisselle & Skalr, LLP

(57) ABSTRACT

A loudspeaker system, and a method and device for actuating a loudspeaker, using a loudspeaker element connected to a memory metal part and provided in a portable electronic device; and a power source unit configured to supply power to the memory metal part, wherein, when power is supplied to the memory metal part, the memory metal part is configured to exert a force on the loudspeaker element to actuate it.

24 Claims, 6 Drawing Sheets

LOUDSPEAKER ACTUATOR

TECHNICAL FIELD OF THE INVENTION

The present invention relates generally to loudspeakers and, more particularly, to actuation of a loudspeaker and means for achieving this.

STATE OF THE ART

Loudspeakers are used in portable electronic devices, such as cellular phones, lap tops and music players, e.g. MP3-players, for emission of sound. The most common means for driving or actuating a loudspeaker are a coil and a magnet that are powered for movement in relation to each other and in correspondence with signals that are analogous to the sound to be emitted, which movement is transmitted to a diaphragm/membrane, often with a conical shape, that moves air in a back and forth movement in response to the signals. Another type of loudspeakers is loudspeakers with flat plane-shaped diaphragms, so-called flat panel speakers, which are driven for example by coils and magnets, by a piezoelectric exciter, an electrical plasma arc, or digitally (digital loudspeakers).

These prior art loudspeakers exhibit disadvantages, e.g. coils and magnets are bulky and heavy requiring a lot of power when actuated, and space when put into the associated device, and also add to the weight of the device. Moreover, a piezoelectric actuator is fragile and do not withstand shocks, it is also too weak, i.e. provides too low power for actuating a loud speaker at low frequencies. The plasma arc loudspeaker that uses electrical plasma as a driver is light since plasma has minimal mass but has problems of maintenance and reliability and is very unsuitable for the mass market due to the fact that the plasma is generated from a tank of helium which must be periodically refilled, for instance. Furthermore, digital loudspeakers require large diaphragms, which mean that they require a lot of space. These disadvantages make prior art loudspeakers difficult to handle, heavy, bulky and often costly.

SUMMARY OF THE INVENTION

In the present invention, the drawbacks of prior art loudspeakers are solved by providing a loudspeaker with a mechanical coupling to a so called muscle wire that is made of shape changing metal, i.e. memory metal, and means for activating this muscle wire.

According to one aspect of the present invention a loudspeaker system is provided comprising at least one flat loudspeaker element mechanically coupled to at least one memory metal part and provided in a portable electronic device, and at least one power source unit configured to supply power to the at least one memory metal part, wherein, when power is supplied to the at least one memory metal part, the at least one memory metal part is configured to exert a force on the flat loudspeaker element to actuate an alternating motion of the loudspeaker element.

According to another aspect a loudspeaker system is provided comprising two memory metal parts, alternately controllable in substantially opposite directions, which parts are arranged to actuate the alternating motion of the loudspeaker element.

In accordance with yet another aspect a loudspeaker system is provided comprising a first and a second memory metal part, where the first memory metal part is arranged to actuate a motion of the loudspeaker element in a first direction and the second memory metal part is arranged to actuate a motion of the loudspeaker element in a second direction substantially opposite the first direction alternately. The loudspeaker system may also comprise one memory metal part, where the memory metal part is arranged to actuate a motion of the loudspeaker element in a first direction, and a spring that is arranged to actuate a motion of the loudspeaker element in a second direction substantially opposite the first direction.

According to yet another aspect the mechanical coupling between the loudspeaker element and each memory metal part is a linkage. The linkage may comprise a first member and a second member, the members being elongated and pivotally connected to each other end to end, and each memory metal part being attached at a first end to the connected ends of the linkage members and at a second end to the portable electronic device.

The invention also relates to a method for actuating a flat loudspeaker element comprises receiving a signal corresponding to sound to be generated by the flat loudspeaker element, providing power to at least one memory metal part being mechanically connected to the flat loudspeaker element upon receipt of the signal, and actuating the flat loudspeaker element by means of the at least one memory metal part exerting a force on the flat loudspeaker element in response to the power being provided to the memory metal part such that an alternating motion of the loudspeaker element is actuated to generate the corresponding sound.

According to one aspect a method for actuating a flat loudspeaker element comprises empowering two memory metal parts alternately, in substantially opposite directions, such that an alternating motion of the loudspeaker element is actuated. The method may comprise providing the power to each memory metal part by dividing the signal into two parts, and contracting each memory metal part in response to these signal parts. This may be performed by contracting one memory metal part in response to one part of the signal, and contracting another memory metal part in response to another part of the signal.

According to another aspect a device comprises means for actuating at least one flat loudspeaker element, the means for actuating including at least one memory metal part being mechanically coupled to the flat loudspeaker element.

In accordance with another aspect a device for actuating a flat loudspeaker element comprises two memory metal parts configured to be controllable in substantially opposite directions, which parts are arranged to actuate an alternating motion of the loudspeaker element.

According to yet another aspect a device for actuating a flat loudspeaker element comprises memory metal parts, each memory metal part being a muscle wire.

The muscle wire withstands mechanical shocks better and also provides a better output response on lower frequencies due to bigger strokes, thereby moving more air. This is due to the fact that a muscle wire is strong, i.e. the muscle wire exert a great force when contracting after being empowered, which means that it has a great efficiency when transforming power into force for actuating a loud speaker element, whereby use of a muscle wire for generating sound reduces the weight of a portable electronic device and also the number of components required for doing this, and therefore reduces the cost of the device. Furthermore, the invention also provides a very low height and a flat shape of the actuator when implemented in a mobile device, whereby the use of the restricted space in such a device is optimized.

It should be emphasised that the term "comprises/comprising" when used in this specification is taken to specify the presence of stated features, integers, steps or components but does not preclude the presence or addition of one or more other features, elements, integers, steps, components or groups thereof.

BRIEF DESCRIPTION OF THE DRAWINGS

The invention will be described in detail below with reference to the accompanying drawings, in which:

FIG. 2 shows a flat loudspeaker panel coupled to muscle wiring, according to one embodiment of the invention, FIG. 3 shows the flat loudspeaker panel coupled to two muscle wires according to another embodiment of the invention.

DETAILED DESCRIPTION OF PREFERRED EMBODIMENTS

A typical loudspeaker consists of a diaphragm that is moved by actuator means, which means are controlled/powered by a control unit or processor in response to sound waves that have been converted into analogue/digital signals. This is known technology and will not be explained in further detail.

Moreover, in this description, the term muscle wire is used to denote an elongate object of shape changing memory metal, e.g. nickel-titanium (Ni—Ti) alloy, see e.g. the trademarks Nitinol and Flexinol. The muscle wire in accordance with the invention may of course have other shapes, e.g. a band- or ribbon-like shape so that the wire may roll (coil) itself up or unroll when changing its shape, a rod or bar shape, or a string/cord/cable shape, and different cross-sections, e.g. circular, triangular, square, star or any other suitable cross-section. The function and performance of these types of memory metal parts or wires are explained further later on in this description.

Figure 1:
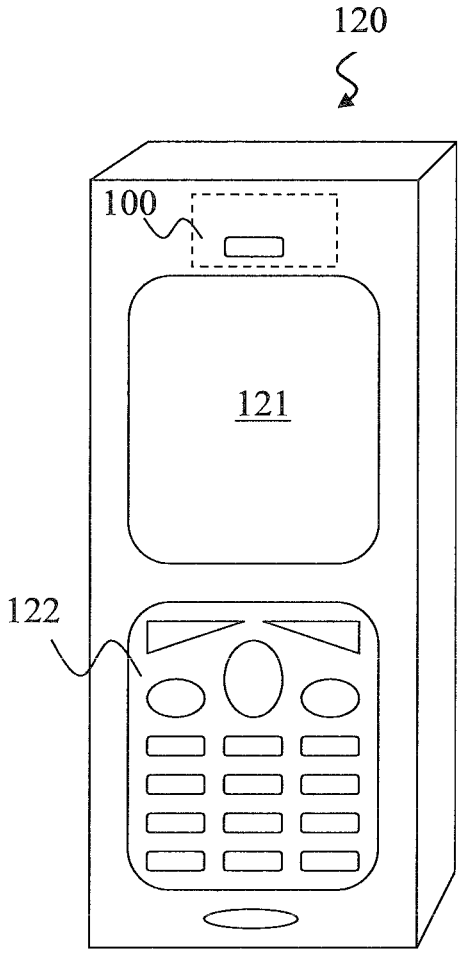
FIG. 1-3 show a portable electronic device equipped with a loudspeaker system according to the invention.
Figure 2:
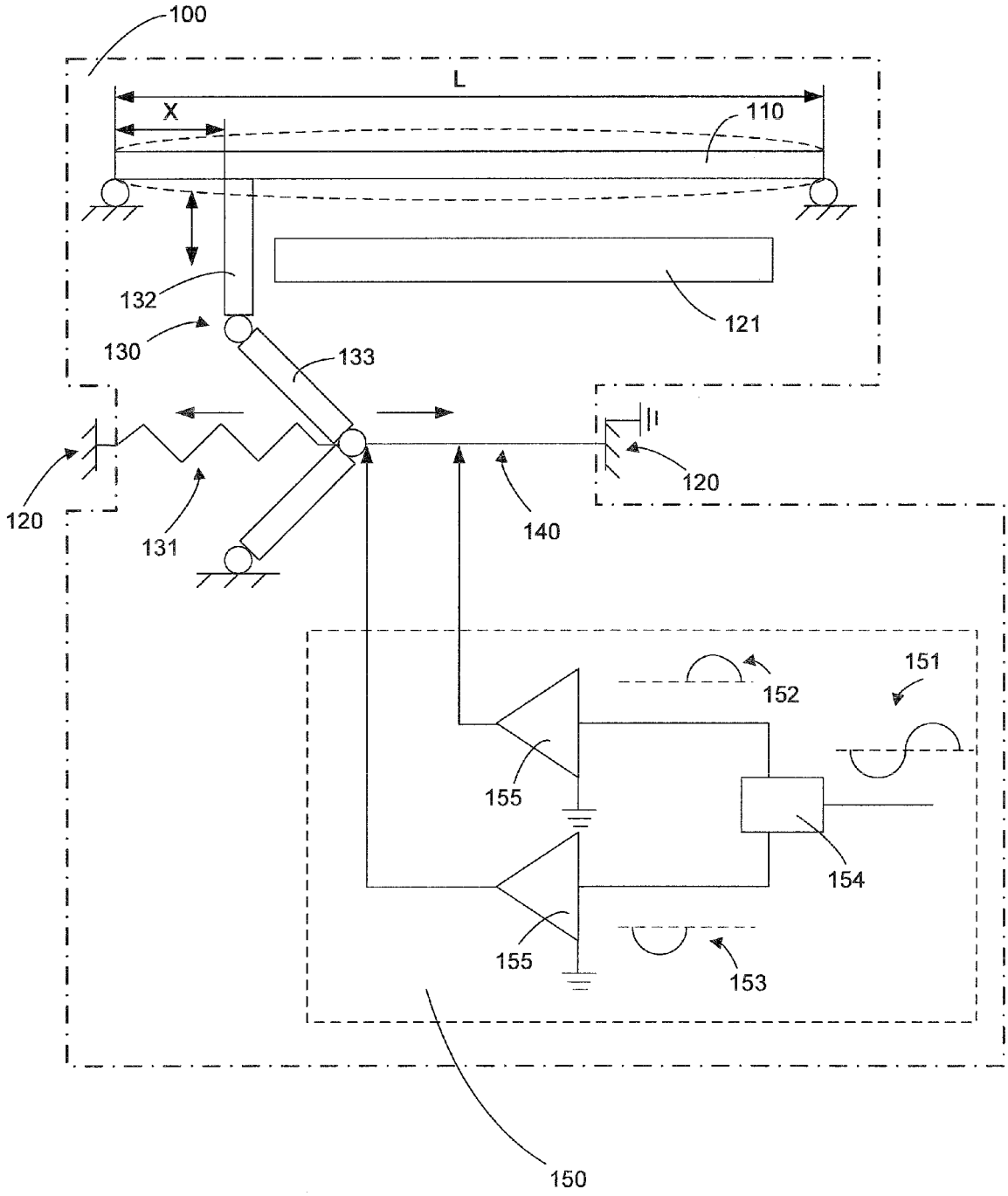
Figure 3:
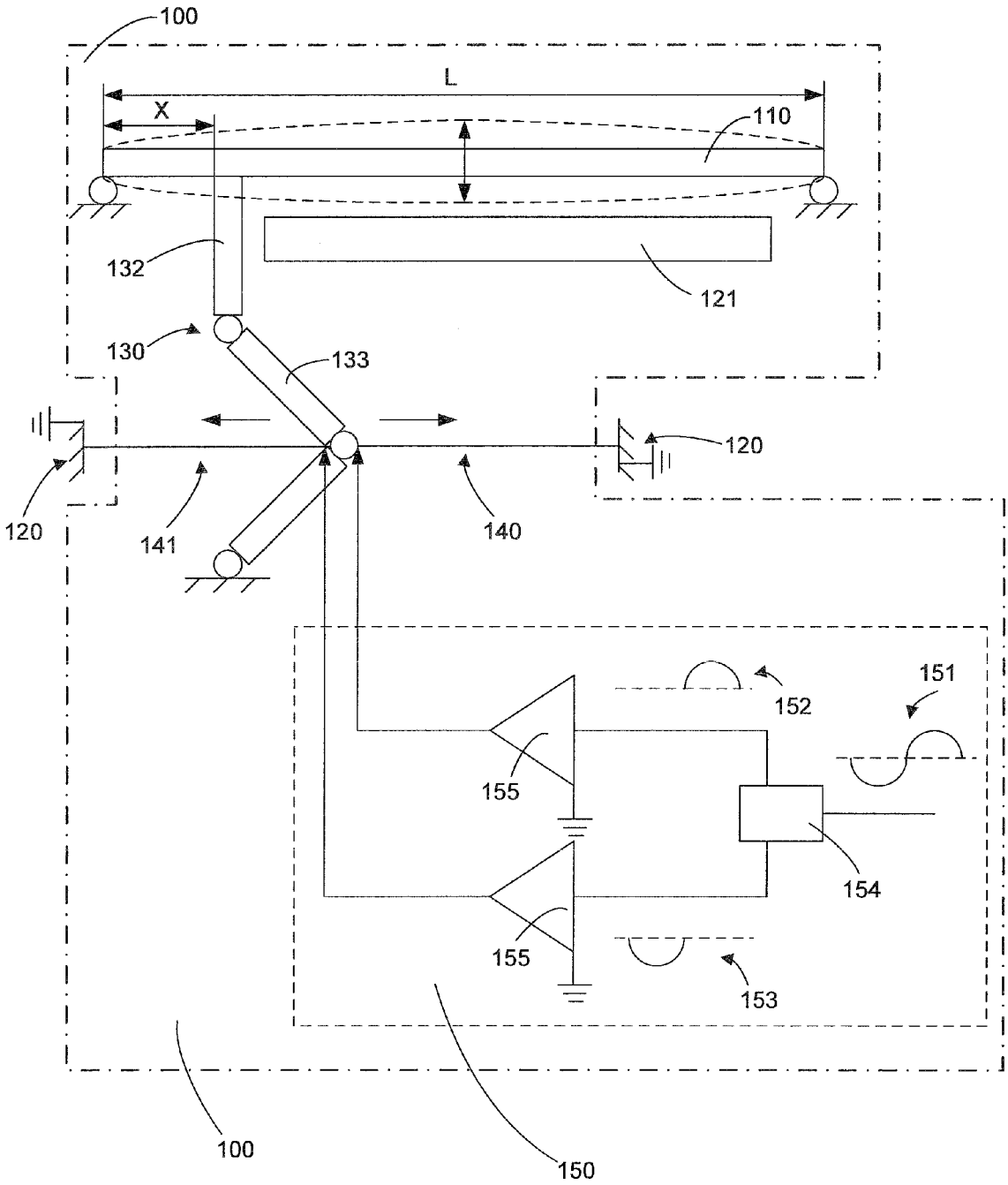

FIG. 1 shows a first embodiment of a loudspeaker system 100 with one flat loudspeaker element in the form of a panel 110 provided in a portable electronic device 120 (shown in FIG. 3 with a display 121 and a key pad 122). The flat loudspeaker element 100 is mounted in the portable electronic device 120 behind and/or above the LCD display 121, as shown in FIGS. 1 and 2.

In the embodiment of FIG. 2, the loudspeaker panel 110 has a mechanical coupling 130 to at least one memory metal part, i.e. a memory metal or muscle wire 140 connected to one control power source unit 150 configured to control and supply power to the wire 140 in response to received signals 151 corresponding to sound to be generated. The mechanical coupling 130 is also connected to a spring 131 that counteracts the memory metal part 140. When power is supplied to the wire 140, the wire is configured to exert a force on the flat loudspeaker panel 110 to actuate an alternating motion of the loudspeaker panel, i.e. the wire 140 contracts in one direction when heated by supplied power while the spring 131 pulls in the substantially opposite direction so that when the power supply to the wire is interrupted, the wire 140 cools and the spring 131 extend the wire by pulling in the opposite direction of the wire contraction. Here, the spring 131 may be eliminated as the loud speaker panel 110, in itself, acts as a spring when the muscle wire 140 first pulls the loud speaker panel in one direction and then retracts when cooled and the loud speaker panel reverts to its original shape. This solution may be used as a buzzer, hummer and/or a howler or any other similar sounds.

In a second embodiment, as shown in FIG. 3, two muscle wires 140 and 141 are mechanically coupled to the loudspeaker panel 110, which wires are connected to a control power source unit 150 configured to control and supply power to each wire 140, 141 by means of signals 151 that is divided into positive and negative half-periods 152, 153 by means of a divider 154, whereby each signal 152 and 153 is amplified by an amplifier 155 before reaching the associated muscle wire 140, 141. These means for controlling the empowering of the muscle wires 140, 141 is used in each embodiment of the invention shown in FIGS. 2-5. In this embodiment of FIG. 3, the spring 131 is replaced with a second memory metal wire 141. When power is supplied to each wire 140, 141, each wire is configured to exert a force on the flat loudspeaker panel 110 to actuate an alternating motion of the loudspeaker panel. The two memory metal wires 140, 141, alternately controllable in substantially opposite directions, to actuate an alternating motion of the loudspeaker panel 110. In this embodiment of the loudspeaker system 100 with a first and a second memory metal wire 140, 141, the first wire 140 to the right is arranged to actuate a motion of the loudspeaker panel 110 in a first direction and the second wire 141 to the left is arranged to actuate a motion of the loudspeaker panel in a second direction substantially opposite the first direction alternately. This is done by the first wire 140 contracting in one direction (to the right in FIG. 2) when heated by supplied power while the second wire 141 is arranged to contract in the substantially opposite direction (to the left in FIG. 2) so that when the power supply to the first wire 140 is interrupted, the first wire 140 cools and the second wire 141 is supplied with power so that it is heated and contracts, thereby extending the first wire 140 by pulling in the opposite direction of contraction for this first wire 140. This control of the alternating wire contractions achieves an alternating motion for the flat loudspeaker panel 110, thereby generating sound.

In the embodiments shown in FIGS. 2 and 3, the mechanical coupling 130 between the loudspeaker panel 110 and each muscle wire 140, 141 is a linkage. The linkage comprises a first member 132 and a second member 133, the members being elongated and movable, in this embodiment pivotally connected to each other end to end, and each memory metal wire 140, 141 being attached at one end to the connected ends of the linkage members 132, 133 and at the other end to the portable electronic device 120.

In another embodiment, each muscle wire 140, 141 could have a linkage instead of a common linkage for both. In that case, the linkage 130 may have members 132, 133 with different lengths and the members could also be positioned and arranged differently, e.g. closer to the middle of the loud speaker panel 110. Furthermore, the distance X from the end of the loud speaker panel 110 in FIGS. 2-5 to the connection of the linkage 130 may be between 0 and L (the total length L of the loud speaker panel 110), e.g. ¾ L, ⅔ L, L/2, L/3, L/4 or any other suitable value so that when the loud speaker panel 110 is moved, suitable shapes of the panel is achieved creating desired sound waves (only one symmetrical shape is shown with dashed lines in FIGS. 2-5 but any other shape is possible, e.g. non-symmetrical shapes).

In FIGS. 2-5, each muscle wire 140, 141 is electrically grounded at its end connection to the portable device at position 120 and electrically isolated at its end connected to the common connection point of the ends of the linkage members 132, 133. Each muscle wire may also be electrically isolated at each end but, in that case, a suitable return path for the current to the amplifiers 155 must be provided. Each amplifier 155 is also electrically grounded at their lower part/corner as shown in FIGS. 2-5.

Figure 4:
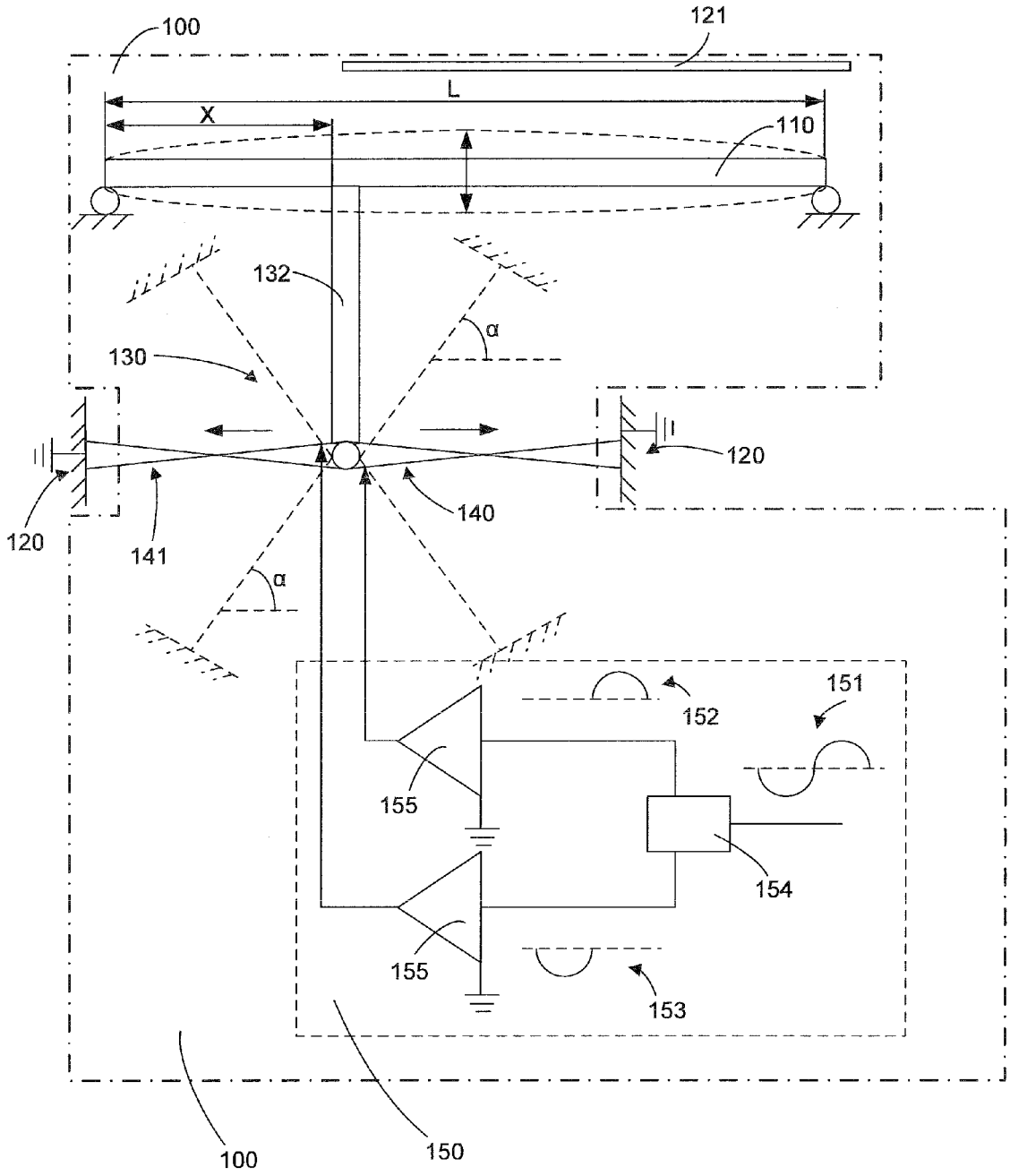
FIG. 4 shows the flat loudspeaker panel coupled to two muscle wires according to still another embodiment of the invention.

In FIG. 4, another embodiment is shown with two crossed muscle wires 140, 141, which cross each other but do not contact each other physically as they are arranged in different planes having a distance between them, i.e. sideways. The conveying of a motion is preferably achieved by arranging each wire as a taut string between two supports and letting a connection point or joint, i.e. the common end connection between the two linkage members 132, 133 contacting the wire, in this embodiment, approximately at the middle of its length, even though other positions are possible, e.g. a third or fourth of its length conveying the force from the memory metal wire, i.e. the increased tension in the muscle wire to the connection point, as would a bowstring to an arrow, and further to the loud speaker panel 110. Here, the wires extend essentially in parallel with the plane of the loud speaker panel 110 but may of course, in other embodiments, e.g. as shown with dashed lines in FIG. 4, act on or affect the connection joint to the loud speaker panel 110 from different angles, i.e. the wires may extend with an angle between the plane of the loud speaker panel 110 and the wires. This angle $\alpha$ in FIG. 4 could be between 5°-90° in one embodiment (not shown), between 10°-80°, preferably between 20°-60°, more preferably between 40°-50°, or most preferably about 45° as shown in FIG. 4.

Figure 5:
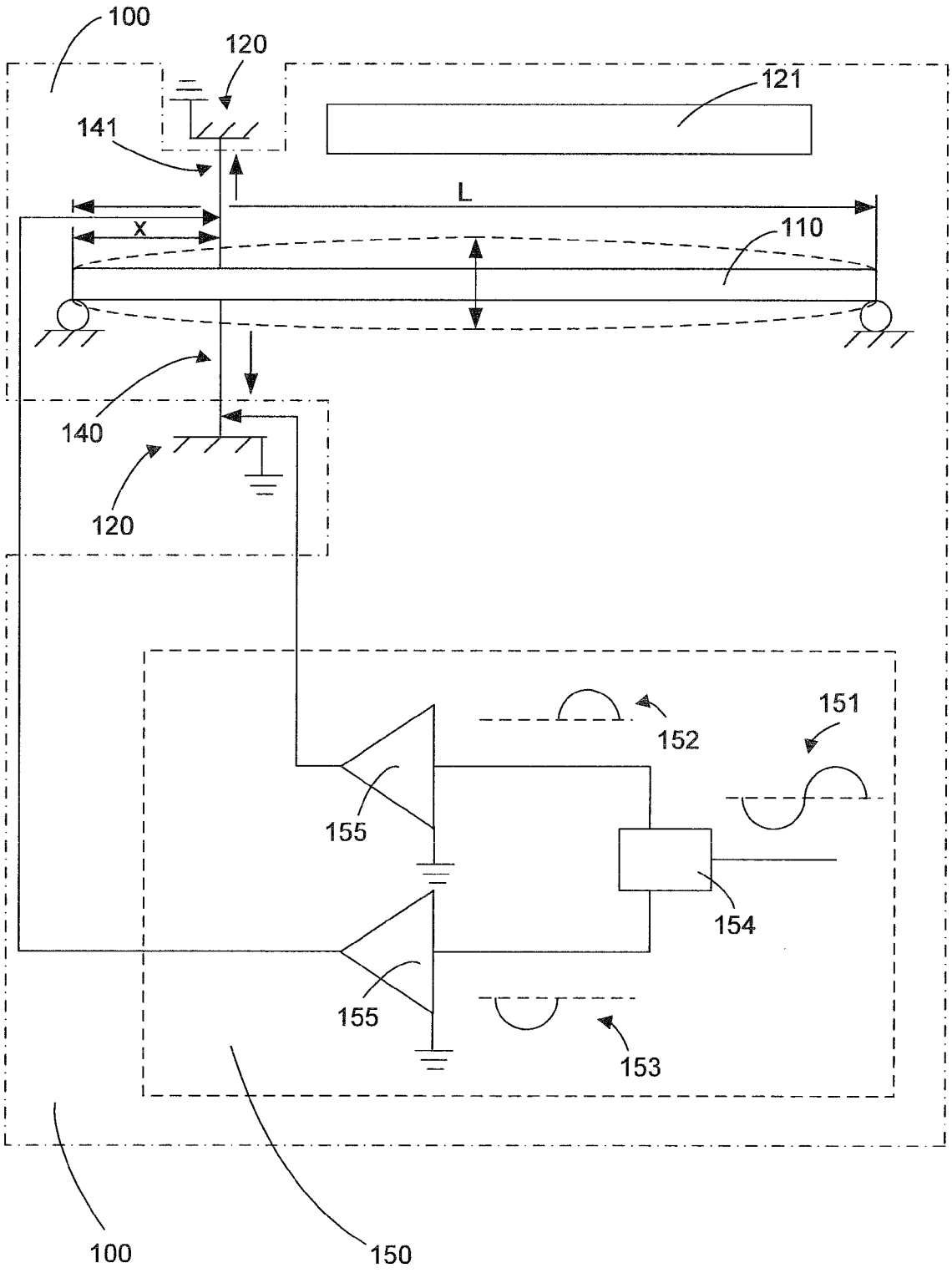
FIG. 5 shows the flat loudspeaker panel coupled to two muscle wires according to yet another embodiment of the invention.
Figure 6:
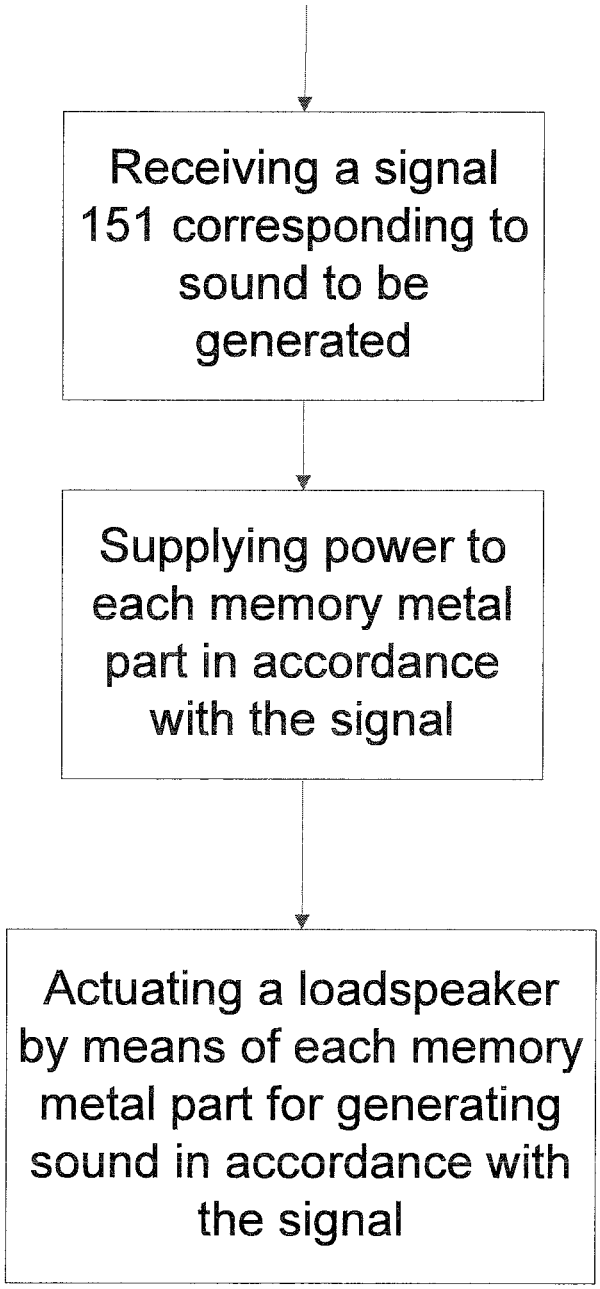
FIG. 6 is a flowchart describing a method for actuating a flat loudspeaker panel by means of muscle wire.

In another embodiment shown in FIG. 5, each memory metal wire 140, 141 is coupled directly to the loudspeaker panel 110. The strokes of the loud speaker panel 110 in this embodiment depends largely on the length of each muscle wire 140, 141, whereby longer wires give bigger strokes. Different lengths of each muscle wire may be achieved by using pulleys connected to the portable device 120 around which each wire is winded. These pulleys may be arranged in different ways and/or on different positions, whereby longer and/or shorter lengths of wire may be achieved, e.g. wires 140 having different lengths or wires with adjustable lengths.

In the embodiments of FIGS. 2-6, a method for actuating the flat loudspeaker panel 110 is performed by receiving a signal 151 corresponding to sound to be generated by the loudspeaker element, and supplying power to each memory metal wire 140, 141 upon receipt of the signal, and actuating the loudspeaker panel in response to the power being provided to the wires. The actuation and movements of the loud speaker panel for generating sound are controlled by feeding the muscle wires with appropriately varying voltages, causing the wires 140, 141 to heat up and contract in a way corresponding to the heating effect of the electrical current passing through the wire. Electrical current fed to the wire for causing a sound frequency may be an electrical current having alternating on and off periods corresponding to the desired frequency. A single twitch of the loud speaker panel is generated by a single pulse.

In the second embodiment in FIG. 3, the two wires 140, 141 are heated alternately, contracting alternately in substantially opposite directions. This alternating heating of the wires 140, 141 is performed by supplying power to the wires by dividing the signal 151 into two parts 152, 153, whereby the wires contract alternately in response to these signal parts 152, 153. In one embodiment, one wire 140 contracts in response to one part 152 of the signal 151, and the other wire 141 contracts in response to the other part 153 of the signal, and in another embodiment one muscle wire 140 contracts in response to a positive part 152 of the signal 151, and the other wire 141 contracts in response to a negative, and inverted part 153 of the signal.

FIG. 1 is a schematic view of the exemplary portable electronic device or mobile terminal 120 with the loud speaker system 100 according to the invention. As used herein, the terms "portable electronic device" or "mobile terminal" may include a cellular radiotelephone 120 as in FIG. 3 but may also be, e.g. a Personal Communications System (PCS) terminal that may combine a cellular radiotelephone with data processing, facsimile and data communications capabilities, a personal digital assistant (PDA) that can include a radiotelephone, pager, Internet/Intranet access, Web browser, organizer, calendar and/or a Global Positioning System (GPS) receiver; and a conventional laptop and/or palmtop receiver or other appliance that includes a radiotelephone transceiver. Mobile terminals may also be referred to as "pervasive computing" devices and may also include cameras. It should also be understood that the invention may also be implemented in other devices or systems that include loud speakers or in a standalone loudspeaker that is connected to a device with no radio communication functionality, e.g. a home cinema loud speaker.

A muscle wire 140, 141 is fabricated from a material that changes shape or size when the material is heated beyond a particular temperature. The particular temperature needed to change the shape/size depends on the particular material. In one implementation, muscle wire 140, 141 may be made of an alloy that is designed to contract (i.e. a fixed length becomes shorter) when the wire 140, 141 is heated beyond a threshold temperature. In addition, the alloy may be fabricated to have poor conductivity (e.g. have resistive characteristics). In this manner, when power is applied to wire 140, 141, the wire becomes heated beyond the threshold temperature, thereby causing wire 140, 141 to contract.

Wire 140, 141, consistent with the invention, may contract about 3% to 5% when heated beyond the threshold temperature. In an exemplary implementation, the threshold temperature may range from about 88 to 98 degrees Celsius. The wire 140, 141, consistent with the invention, may also relax (i.e. return to the pre-heated state) at a temperature ranging from about 62 degrees to 72 degrees Celsius. In the future, muscle wires 140, 141 that contract more or less and/or retract at lower and/or higher temperatures may be developed due to other physical properties.

The table below illustrates exemplary characteristics of wire 140, 141 that may be used in implementations consistent with the invention.

| | | |
|---|---|---|
| Wire diameter (millimeters) | 0.05 | 0.125 |
| Resistance (ohms/meter) | 510 | 70 |
| Typical power (watts/meter) | 1.28 | 4.4 |
| Contraction speed at typical power (seconds) | 1 | 1 |
| Maximum recovery force (grams) | 117 | 736 |
| Deformation force (grams) | 8 | 43 |
| Heat capacity (Joules/g) | 0.32 | 0.32 |

In a typical application, the electrical energy fed to a muscle wire 140, 141 is a pulse of amplitude 5 Volts, a current of 300 mA during 70 ms.

The invention claimed is:

1. A loudspeaker system, comprising:

at least one flat loudspeaker element mechanically coupled to at least one memory metal part and provided in a portable electronic device; and at least one power source unit configured to supply power corresponding to sound to be generated to the at least one memory metal part, wherein, when power is supplied to the at least one memory metal part, the at least one memory metal part is configured to exert a force on the flat loudspeaker element to actuate an alternating motion of the loudspeaker element so that the loudspeaker element generates the corresponding sound.

2. The loudspeaker system of claim 1, comprising two memory metal parts, alternately controllable in substantially opposite directions, which parts are arranged to actuate the alternating motion of the loudspeaker element.

3. The loudspeaker system of claim 2, comprising a first and a second memory metal part, where the first memory metal part is arranged to actuate a motion of the loudspeaker element in a first direction and the second memory metal part is arranged to actuate a motion of the loudspeaker element in a second direction substantially opposite the first direction alternately.

4. The loudspeaker system of claim 2, comprising one memory metal part, where the memory metal part is arranged to actuate a motion of the loudspeaker element in a first direction, and a spring that is arranged to actuate a motion of the loudspeaker element in a second direction substantially opposite the first direction.

5. The loudspeaker system of claim 2, wherein each memory metal part is coupled directly to the loudspeaker element.

6. The loudspeaker system of claim 1, wherein the mechanical coupling between the loudspeaker element and each memory metal part is a linkage.

7. The loudspeaker system of claim 6, wherein the linkage comprises a first member and a second member, the members being elongated and pivotally connected to each other end to end, and each memory metal part being attached at a first end to the connected ends of the linkage members and at a second end to the portable electronic device.

8. The loudspeaker system of claim 7, wherein the first linkage member is pivotally connected to the loudspeaker element at a first end and pivotally connected with its second end to a first end of the second linkage member, which second linkage member is pivotally connected to the portable electronic device at a second end, and the common joint between the first and the second linkage member being connected to each first end of each memory metal part.

9. The loud speaker system of claim 1, wherein the actuation of the motion of the loudspeaker element is achieved by arranging each memory metal part as a taut string between two supports connected to the portable electronic device and letting a joint contacting the memory metal part between the two supports conveying the force from the memory metal part to the loudspeaker element.

10. The loudspeaker system of claim 1, wherein the memory metal part is mechanically coupled to the loudspeaker element at a first end and to the portable electronic device at a second end.

11. A method for actuating a flat loudspeaker element, comprising:

receiving a signal corresponding to sound to be generated by the flat loudspeaker element, providing power to at least one memory metal part being mechanically connected to the flat loudspeaker element upon receipt of the signal, and actuating the flat loudspeaker element by means of the at least one memory metal part exerting a force on the flat loudspeaker element in response to the power being provided to the memory metal part such that an alternating motion of the loudspeaker element is actuated to generate the corresponding sound.

12. The method of claim 11, comprising:

empowering two memory metal parts alternately, in substantially opposite directions, such that the alternating motion of the loudspeaker element is actuated.

13. The method of claim 12, comprising:

empowering a first and a second memory metal part alternately such that the first memory metal part actuates a motion of the loudspeaker element in a first direction and the second memory metal part actuates a motion of the loudspeaker element in a second direction substantially opposite the first direction alternately.

14. The method of claim 11, comprising:

providing the power to each memory metal part by dividing the signal into two parts, and contracting each memory metal part in response to these signal parts.

15. The method of claim 14, comprising:

contracting one memory metal part in response to one part of the signal, and contracting another memory metal part in response to another part of the signal.

16. The method of claim 15, comprising:

contracting one memory metal part in response to a positive part of the signal, and contracting another memory metal part in response to a negative and inverted part of the signal.

17. A device, comprising:

means for actuating an alternating motion of at least one flat loudspeaker element to generate sound, the means for actuating including at least one memory metal part being mechanically coupled to the flat loudspeaker element.

18. The device of claim 17, comprising two memory metal parts configured to be controllable in substantially opposite directions, which parts are arranged to actuate the alternating motion of the loudspeaker element.

19. The device of claim 17, wherein the mechanical coupling between the loudspeaker element and each memory metal part is a linkage.

20. The device of claim 19, wherein each linkage comprises a first elongated member and a second elongated member, the members being pivotally connected to each other end to end, and each memory metal part being attached at a first end to the connected ends of the linkage members and at a second end to the portable electronic device.

21. The device of claim 20, wherein the first linkage member is pivotally connected to the loudspeaker element at a first end and pivotally connected with its second end to a first end of the second linkage member, which second linkage member is pivotally connected to the portable electronic device at a second end, and the common joint between the first and the second linkage member being connected to each first end of each memory metal part.

22. The device of claim 17, wherein each memory metal part is coupled directly to the loudspeaker element.

23. The device of claim 17, wherein the actuation of the motion of the loudspeaker element is achieved by arranging each memory metal part as a taut string between two supports connected to the portable electronic device and letting a joint contacting the memory metal part between the two supports conveying the force from the memory metal part to the loudspeaker element.

24. The device of claim 17, wherein each memory metal part is a muscle wire.

* * * * *